United States Patent [19]

Weidner et al.

[11] 4,387,649

[45] Jun. 14, 1983

[54] ELECTRICAL PROJECTILE DETONATOR

[75] Inventors: Peter Weidner, Breitenbrunn; Harald Wich, Kulmbach, both of Fed. Rep. of Germany

[73] Assignee: Diehl GmbH & Co., Fed. Rep. of Germany

[21] Appl. No.: 193,828

[22] Filed: Oct. 3, 1980

[30] Foreign Application Priority Data

Oct. 4, 1979 [DE] Fed. Rep. of Germany ..... 2940227

[51] Int. Cl.[3] ..... F42C 9/00; F42C 11/06

[52] U.S. Cl. ..... 102/215; 102/206; 102/216

[58] Field of Search ..... 102/216, 215, 218-220, 102/206, 266

[56] References Cited

U.S. PATENT DOCUMENTS

| | | | |
|---|---|---|---|
| 3,500,746 | 3/1970 | Ambrosini | 102/215 |
| 3,657,571 | 4/1972 | Martin et al. | 102/215 |
| 4,044,680 | 8/1977 | Ziemba | 102/216 |

FOREIGN PATENT DOCUMENTS 2838055 3/1979 Fed. Rep. of Germany .

*Primary Examiner*—Charles T. Jordan

*Attorney, Agent, or Firm*—Scully, Scott, Murphy & Presser

[57] ABSTRACT

An electrical projectile detonator which includes a voltage source, an impact detector, a timing element as well as an ignition switch which is arranged intermediate the voltage source and a detonating agent, and wherein the timing element is connected with the impact detector and the ignition switch.

6 Claims, 4 Drawing Figures

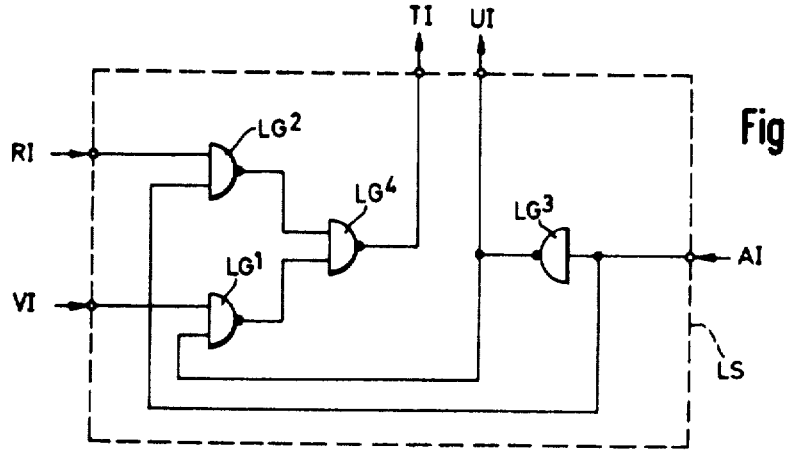
Fig. 3
Fig. 4
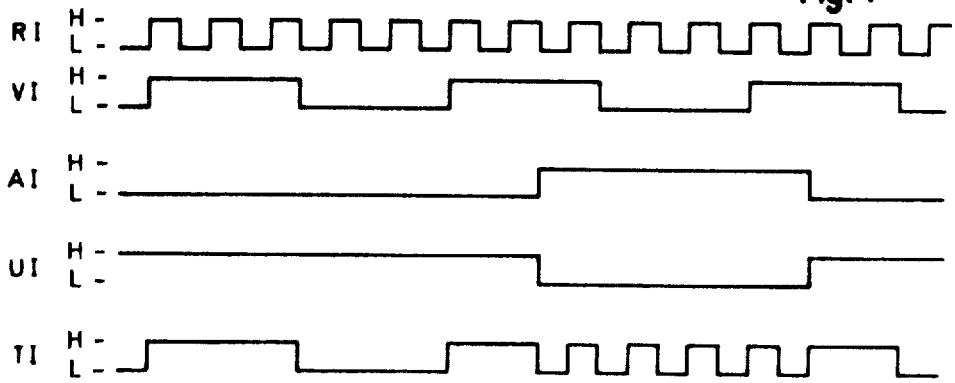

ELECTRICAL PROJECTILE DETONATOR

BACKGROUND OF THE INVENTION

1. Field of the Invention

The present invention relates to an electrical projectile detonator which includes a voltage source, an impact detector, a timing element or circuit as well as an ignition switch which is arranged intermediate the voltage source and a detonating agent, and wherein the timing element is connected with the impact detector and the ignition switch.

2. Discussion of the Prior Art

The electrical detonators of the above-mentioned type, after the voltage source has been charged, for instance at firing, there is started a countdown timer which at the end of the countdown time will trigger an ignition switch through a scanning impulse so as to cause ignition of the detonating agent and the projectile is exploded. When the projectile impacts against a target prior to the self-destruction, then a delay timer will be started through an impact sensor, so as to produce a time lag in dependence upon the already expended flight time, which corresponds to a constant penetration depth or lag path. This signifies that the lag time increases in proportion to the reduction in the velocity of the average projectile. The lag time is so selected whereby the lag path will, for example, constantly consist of 20 cm.

An electrical detonator of that type has already become known from German laid-open Patent Application No. 21 13 126. This contains in an analog circuit and technology a countdown timer for self-destruction, as well as a lag timer which can be triggered by an impact sensor. In this previously known detonator the ignition time period is determined through RC-elements which control thyristors and quadripole diodes or silicon-controlled rectifiers. The preciseness of the time interval, particularly the precision of the setting of the lag time, depends upon the manufacturing tolerances of this components, as well as the capability of reproducing the charging sequence of the voltage source at the firing of the projectile. It is known that in analog circuits with increasing demands on their quality, which herein will above all express themselves in the reproduceability of the countdown time, there will disproportionally increase the complexities of the circuit and the costs. Moreover, complex analog circuits necessitate a correspondingly high need for volumetric displacement and for energy so as to render their use possible in only relatively large projectiles.

Furthermore, for large combat distances and correspondingly lengthy flight times for the projectile it is necessary to have a capability for a precise setting of the lag time prior to firing so that, with an increasing flight time, the projectile velocity will no longer change as extensively as immediately of the firing. Thus, a fixedly set lag time of the previously known detonator which is dependent upon manufacturing tolerances, restricts the effectiveness of the ammunition to an unnecessarily narrow combat range.

SUMMARY OF THE INVENTION

Accordingly, it is an object of the present invention to provide an electrical projectile detonator of the above-mentioned constructional type which meets the hereinabove set forth requirements, in essence, a high degree of precision in detonation or ignition time point control, a particularly exact lag time settability at low volume and energy demands.

The inventive utilization of logic components of digital electronics facilitates an inexpensive realization of detonation time control with the desired precision which is required by the current case of application.

The inventive construction of the detonation time control furthermore facilitates the utilization of monolithically, constructed semiconductor components, in particular CMOS components, whose low energy demand can be satisfied, for example, through piezo elements chargeable during firing, and whose low volumetric requirement facilitates the use of these detonators even in small projectiles.

In an advantageous embodiment of the invention, the forward count frequency of the counter is selected to be smaller than the backward count frequency. Through suitable selection of these frequencies, there can be set the countdown and lag time at the desired degree of precision, for which purpose there can be employed at least one oscillator which, as needed, may have at least one frequency divider connected to the output thereof.

A particular advantage is afforded by the inventive employment of a counter which is resettable to an externally programmable count condition. Achievable hereby is that the lag time which increases with the flight time has a constant time superimposed thereon, so as to render possible a penetration of the projectile even at a close combat distance.

BRIEF DESCRIPTION OF THE DRAWINGS

Reference may now be had to two preferred embodiments of the invention, taken in conjunction with the accompanying drawings; in which:

FIG. 3 is a logic circuit pursuant to the invention; and

FIG. 4 is a representation of the impulse sequences occurring in the circuits of FIG. 2.

DETAILED DESCRIPTION

Figure 1:
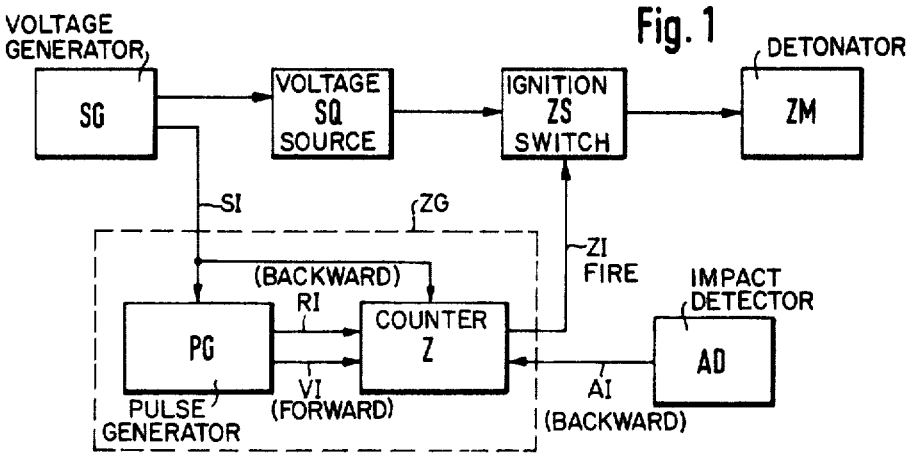
FIG. 1 is a block circuit diagram of a first embodiment of a countdown and lag time control pursuant to the invention.

According to FIG. 1, a voltage generator SG generates, in a known manner, electrical energy at firing, which is given off to a voltage source SQ, for example, a condenser. This voltage generator SG can be represented, for instance, by an external battery or through a piezo element which can be acted upon at starting. Furthermore, the voltage generator SG supplies a start-impulse SI to a counter Z, as well as to a pulse generator PG which is connected therewith and which generates forward and backward count impulses VI and RI, both of which are set back and started through the start impulse to a programmable count position. At firing, the counter Z will count up in synchronism with the forward count impulses VI and, at overrunning, in case there is encountered no previous impact, will emit a scanning or firing impulse ZI which, through the intermediary of an ignition switch, for example a thyristor, will connect the voltage source SQ with a detonating agent ZM and thereby detonate the latter. At an impact of the projectile which occurs prior to self-destruction, an impact impulse AI is emitted by the impact detector AD, which switches the counter Z into the backward count direction and allows for counting backwards.

The counter Z will now count back to a predeterminable count condition and will then emit a scanning or firing signal ZI which again ignites the detonating medium ZM.

Figure 2:
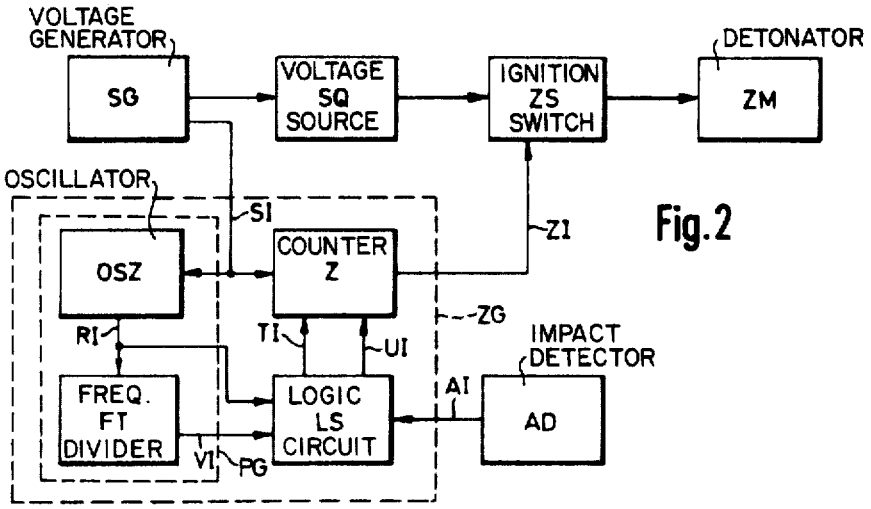
FIG. 2 is a block circuit diagram of a second embodiment.

Illustrated in FIG. 2 is a second embodiment of the invention. In this instance, the pulse generator PG consists of an oscillator OSZ which generates the backward count impulses RI and of a frequency divider FT connected to the output of the oscillator which produces the forward count impulses VI. The forward count and backward count impulses VI and RI act upon a logic circuit LS (refer to FIG. 3) consisting of four NAND gates LG1–LG4 which, at the application of the impact impulse AI, will switch the counter Z from the forward count direction into the backward count direction through a switching impulse UI and will act upon the counter Z with the corresponding timing impulses TI. (Refer to FIG. 4).

Represented in FIG. 3 is the logic circuit LS whose task resides in providing the inventive control of the counter Z. For this purpose, the forward and backward count impulses VI and RI are presently conducted to the inputs of dual-NAND gates LG1 and LG2. The two other inputs of the dual-NAND gates LG1 and LG2 are connected with an output, respectively, an input controllable by impact impulse AI of another single-NAND gate LG3, wherein the switching impulse UI can be generated at the output of this single-NAND gate LG3, which allows for the forward and backward counting of the counter. The outputs of the initially mentioned dual-NAND gates LG1 and LG2 are interconnected through a further dual-NAND gate LG4 which at the output side thereof, in accordance as to whether or not the impact impulse AI acts on the single-NAND gate, will transmit the timing impulses TI, in essence the backward or forward count impulses RI or VI, to the counter Z.

Illustrated in FIG. 4 are binary impulse sequences RI, VI, AI, UI and TI which alternate between two voltage levels L and H, which pursuant to the exemplary embodiments of FIGS. 1 and 2, are required for the control of the detonating time point.

Within the context of the invention these can also be employed a counter Z which presently utilize one input for the forward and backward count impulses VI and RI, and which internally pursuant to the indication of the impact impulses AI switches over between the forward and backward count impulses VI and RI.

Two embodiments of the inventive ignition or detonation time point control, which operate with different degrees of precision, are now described by way of example.

In a first single example there is employed a four-bit counter Z, for instance an RCA CD 4510, which can be acted upon with a backward count frequency of, for example, 16,384 KHz and a forward count frequency of, for example, 1 Hz, through the logic circuit LS. At firing, the counter Z is set to a programmable count condition and commences to count up in 1 Hz pulse. In the event that as impact occurs, after at most 15 seconds the counter Z, will emit a scanning impulse ZI at an overrun-output. Contrastingly, an impact which occurs prior to self-destruction after 15 seconds at the latest, effects the essentially more rapid backward count of the counter Z in the 16,384 KHz pulse. When the count position reaches zero value, then similarly a scanning impulse ZI is given off at the overrun-output over the detonating material ZM is ignited through the detonating switch ZS.

Through the selection of the pulse frequency through which the counter Z is counted up (1 Hz) there is effected a step-like change in the delay or lag time. In order to facilitate a most possibly continual time control, there is required a fine subdivision of the digital steps. Naturally, interrelated therewith is also a higher demand on the components with respect to the count steps at a concurrent selection of another operating frequency for the oscillator OSZ.

In an inventive application of the detonation time point control there must be further considered that, in accordance with the phase position of the backward count impulse RI at impact, the set lag time which depends upon the flight time evidences maximum deviations, which are proportional to the period interval of the backward count impulses RI and, in the above-mentioned example, consist of up to 122 μs.

In a second exemplary embodiment satisfying higher precision requirements, there can be inventively achieved a refining in the lag time steps and a reduction in these maximum deviations, for example by a factor of 16, in that in lieu of a four-bit counter there is employed an eight-bit counter, for instance, consisting of two series-connected CD 4510 circuits, which is controlled with a backward count of, for example, 524,288 KHz and a forward count frequency of, for example, 16 Hz. In this instance the self-destruction occurs, according to the programming of the reset count condition, after 15 seconds at the latest. Through this programming, in an advantageous manner the progressively developing lag time can have a constant time superimposed, for instance 85 μs, so that also at even at short range is there afforded a penetration of the projectile.

We claim:

1. In an electrical projectile detonator including a voltage source, an impact detector, a timing circuit, and an ignition switch coupled between said voltage source and a detonator, said timing circuit being coupled to said impact detector and said ignition switch, said timing circuit including a forward-backward counter and a pulse generator coupled to said counter for generating forward and backward counting pulses, with the frequency of the forward counting pulses being less than the frequency of the backward counting pulses, said counter being activated in the forward counting mode upon firing of the projectile and generating a firing signal to said ignition switch to detonate said detonator upon the counter reaching a given high count, said impact detector activating said counter in a backward counting mode upon the occurrence of an impact by the projectile to cause the counter to count backward, from the count previously reached in the forward counting mode, at the higher frequency of the backward counting pulses to generate a firing signal to said ignition switch to detonate said detonator upon the counter reaching a given low count.

2. Electrical projectile detonator as claimed in claim 1, further comprising a voltage generator supplying said counter and said pulse generator with a starting impulse during firing.

3. Electrical projectile detonator as claim in claim 2, said pulse generator including an oscillator generating the backward count impulses; and a frequency divider connected to the output of said pulse generator for generating the forward count impulses.

4. Electrical projectile detonator as claimed in claim 1, said pulse generator comprising a logic circuit consisting of logic interconnections, said logic circuit controlling the counter which is adapted to be switched by the impact impulse with either forward or backward count impulses.

5. Electrical projectile detonator as claimed in claim 1, said counter being resettable to an externally programmable count condition.

6. Electrical projectile detonator as claimed in claim 2, said voltage generator charging said voltage source during firing of said projectile.

* * * * *